United States Patent [19]

Mack

[11] Patent Number: 4,621,837

[45] Date of Patent: Nov. 11, 1986

[54] MULTI-LAYERED LABEL

[75] Inventor: Jory B. Mack, Chicago, Ill.

[73] Assignee: Pamco Label Co., Rosemont, Ill.

[21] Appl. No.: 696,773

[22] Filed: Jan. 31, 1985

[51] Int. Cl.[4] ..... B42D 15/00; G09F 3/00; B41L 1/20

[52] U.S. Cl. ..... 283/105; 283/56; 283/81; 282/9 R

[58] Field of Search ..... 283/56, 52, 61, 74, 283/79, 81, 105; 282/9 R; 281/2, 5; 229/16 A, 34 B, 92.7, 73, 74; 40/2 R, 306, 615

[56] References Cited

U.S. PATENT DOCUMENTS

| | | | |
|---|---|---|---|
| 1,896,834 | 2/1933 | Brown . | |
| 1,924,909 | 8/1933 | Brown . | |
| 1,949,903 | 3/1934 | Fales . | |
| 1,974,401 | 9/1934 | Miller . | |
| 2,093,985 | 9/1937 | Stansbury . | |
| 2,127,081 | 8/1938 | Brown . | |
| 2,614,349 | 10/1952 | Barnes . | |
| 2,706,865 | 4/1955 | Miller . | |
| 3,638,966 | 2/1972 | Wiersma . | |
| 3,858,792 | 1/1975 | Volkert | 283/56 |
| 3,859,958 | 1/1975 | Luscher . | |
| 3,871,639 | 3/1975 | Felix . | |
| 3,994,118 | 11/1976 | Felix . | |
| 4,104,816 | 8/1978 | Pingeton . | |
| 4,276,334 | 6/1981 | Sugihara | 283/81 |
| 4,323,608 | 4/1982 | Denny et al. . | |
| 4,331,327 | 5/1982 | Felix . | |
| 4,334,672 | 6/1982 | Felix . | |
| 4,406,650 | 9/1983 | Felix . | |
| 4,407,524 | 10/1983 | Trautlein | 282/9 R |
| 4,529,229 | 7/1985 | Glibbery | 283/81 |
| 4,534,582 | 8/1985 | Howard . | |

FOREIGN PATENT DOCUMENTS

| | | | |
|---|---|---|---|
| 0043179 | 3/1981 | European Pat. Off. . | |
| 8100088 | 8/1981 | Int'l Pat. Institute . | |
| 270850 | 12/1950 | Switzerland | 229/73 |
| 1397787 | 10/1972 | United Kingdom . | |
| 1596306 | 7/1977 | United Kingdom . | |
| 2046717 | 3/1980 | United Kingdom . | |
| 2054529 | 6/1980 | United Kingdom . | |
| 2073716 | 4/1981 | United Kingdom . | |
| 2119345 | 4/1982 | United Kingdom . | |

*Primary Examiner*—Paul A. Bell
*Assistant Examiner*—Paul M. Heyrana, Sr.
*Attorney, Agent, or Firm*—Garrettson Ellis

[57] ABSTRACT

A multi-layered label which may be torn open to expose an interior leaflet. First and second cover sheets are peripherally sealed together, typically with end seals. A multi-layered leaflet member is positioned between the first and second cover sheets, at least one layer of the leaflet member being sealed to an internal face of one of the first and second sheets. A line of tearing weakness in the first cover sheet permits opening thereof for access to the leaflet member.

14 Claims, 13 Drawing Figures

FIG. 1
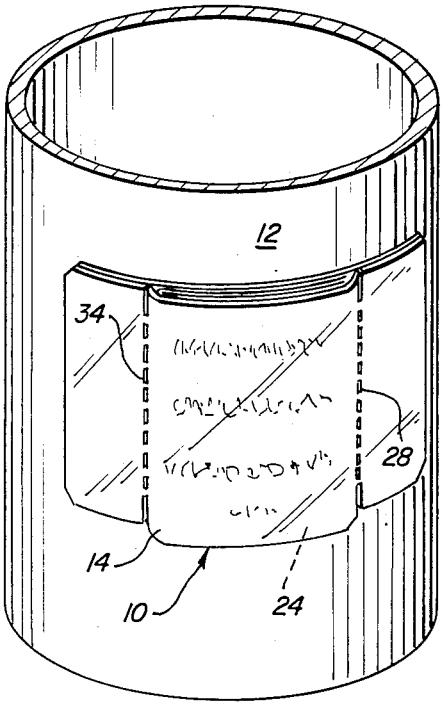
FIG. 2
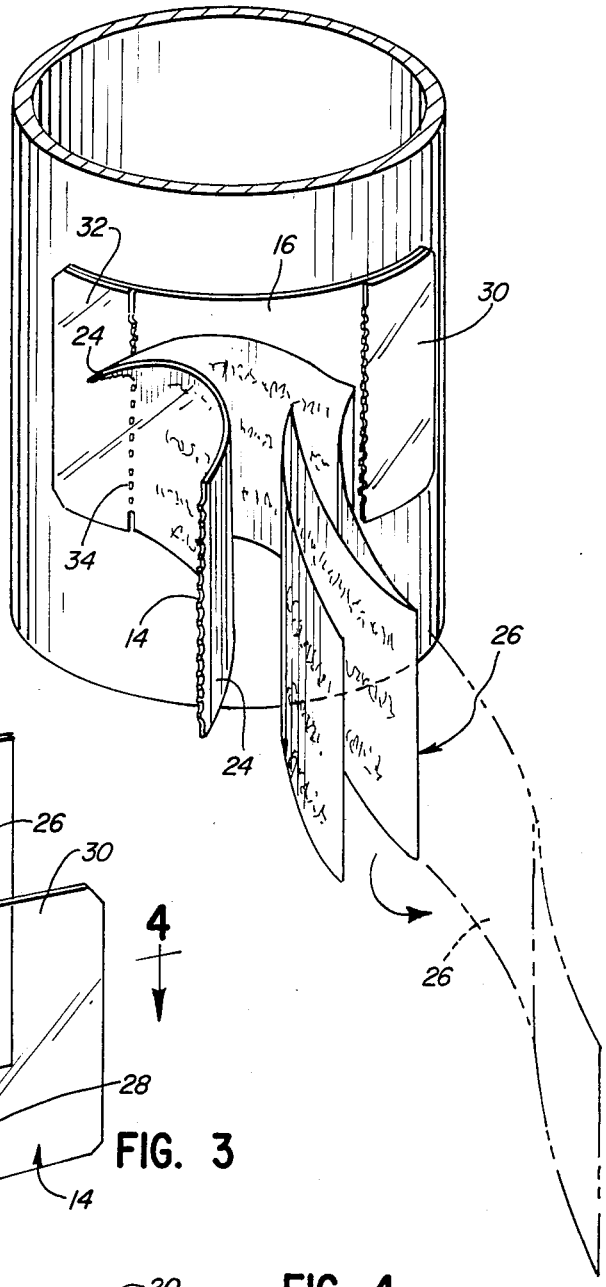
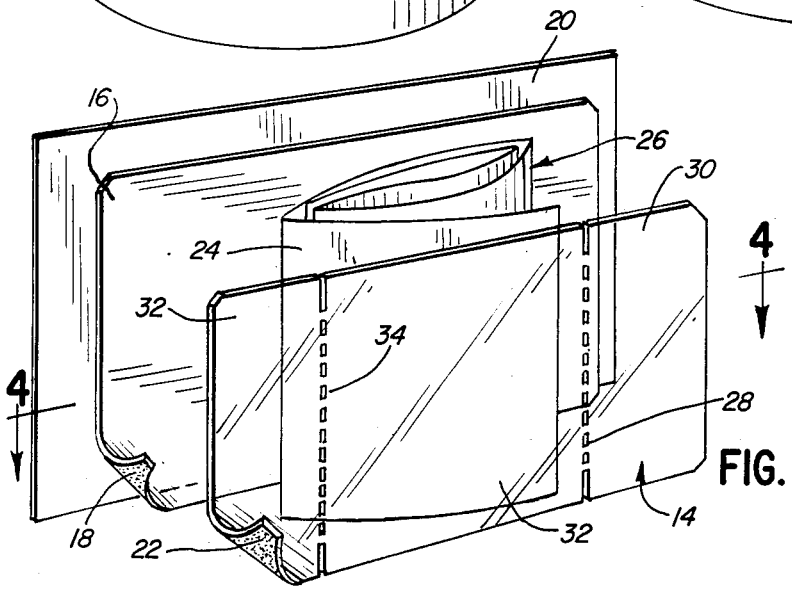
FIG. 3
FIG. 4
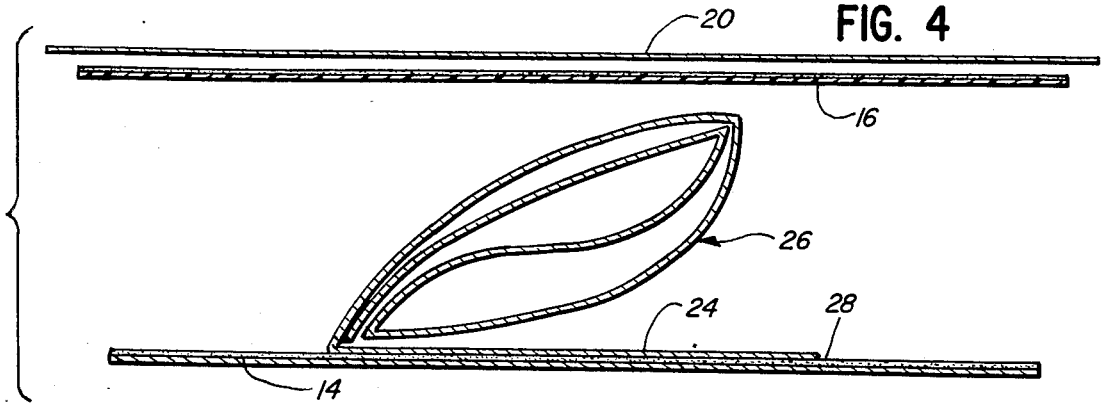

FIG. 9
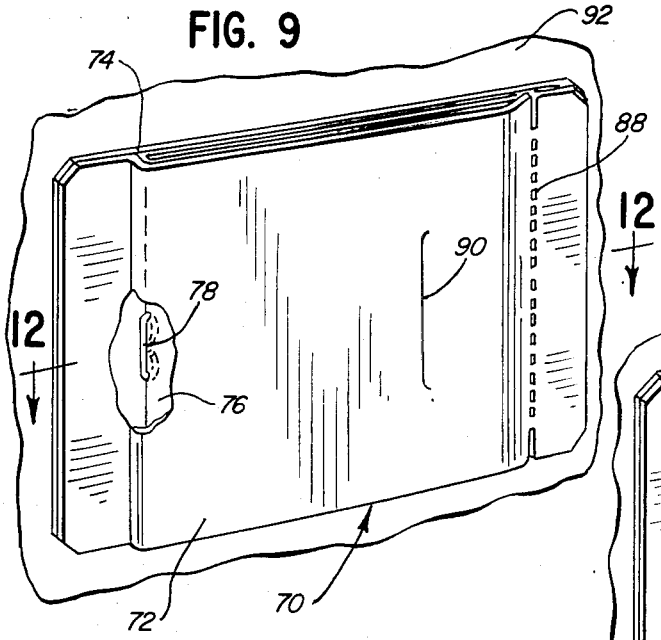
FIG. 10
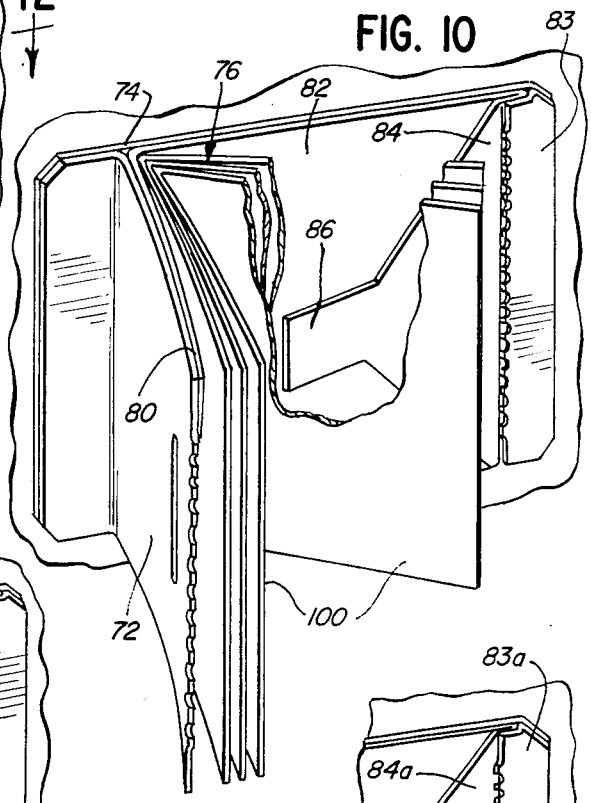
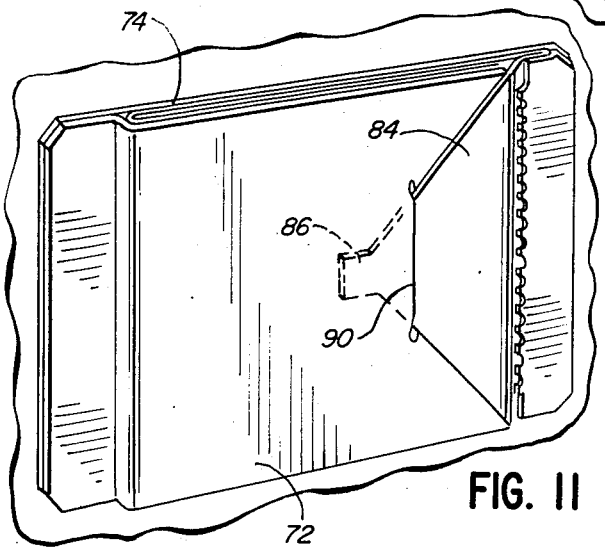
FIG. 11
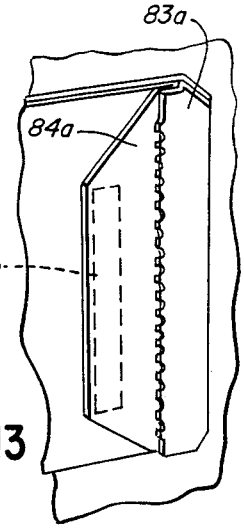
FIG. 13
FIG. 12
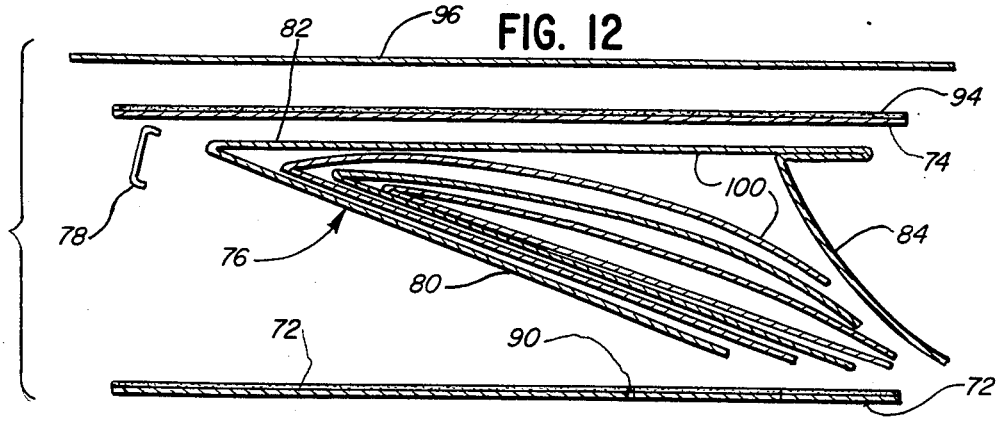

MULTI-LAYERED LABEL

BACKGROUND OF THE INVENTION

In the packaging of certain chemicals, drugs and the like, the need often arises to provide the user with a great deal of information on the label. This may be necessary because of regulations laid down by Government Agencies, and also to provide the user with instructions on how to effectively and safely use the product, etc.

Accordingly, labels having multiple layers which may be opened for reading have become commercially available. See for example U.S. Pat. No. 4,323,608. However, success in the label market requires manufacturers to provide labels that are very cost effective and inexpensive to manufacture. The labels of the prior art have not been as inexpensively manufacturable as would be most desirable. Furthermore, various advantageous features for labels are lacking.

In accordance with this invention, a multi-layered label is provided which can be manufactured for a fraction of the cost of the prior art labels. Furthermore, the labels may exhibit added beneficial features such as a recloseability of the multi-layered label by the user, so that the information contained in the label may be preserved during use of the container.

DESCRIPTION OF THE INVENTION

A multi-layered label is provided which may be torn open to expose an interior leaflet. In accordance with this invention, first and second cover sheets are peripherally sealed together, typically with seals just at opposed ends of the label. A typically separate, multi-layered leaflet member is positioned between the first and second cover sheets, at least one layer of the leaflet member being sealed to an internal face of one of the first and second sheets. Typically, the internal face of the first sheet is coated with contact adhesive and retains the leaflet member.

A line of tearing weakness is provided in the first cover sheet to permit opening thereof for access to the leaflet member.

It has been found that by the use of separate first and second cover sheets, with a multi-layer leaflet member being secured to one or both inside surfaces of the first and second cover sheet, a design of multi-layered label is provided which is susceptible to automated manufacturing procedures, having the effect of greatly reducing the cost of such labels, when compared with the labels of the prior art.

It is desirable in certain modes of use for the label of this invention to have a first cover sheet which is made of transparent material. Thus, the printing on the leaflet member is visible through the cover sheet, and the cover sheet does not have to be printed.

The leaflet member may be in booklet form, or it may be a strip folded into a plurality of layers with one face of an end panel of the strip being laminated or glued to an inner surface of one of the cover sheets.

In another advantageous embodiment, an end of either the leaflet member or the second cover sheet defines a tab member which is positioned by folding between the first and second cover sheets. The first cover sheet then defines a slot positioned and proportioned to receive the tab, for reclosing of the label after opening thereof.

The second cover sheet typically carries an adhesive layer on its outer face for application of the label to a surface, although any other conventional application means of the label may be used if desired. When the adhesive layer is present, a removable backing covering the adhesive layer is also generally provided for protection of the adhesive layer until use.

One specific, multi-layered label of this invention includes the first and second cover sheets sealed together at opposed ends, and a multi-layer, folded leaflet member positioned between the first and second cover sheets. At least the first cover sheet is transparent, with one layer of the leaflet member defining a printed, outer face which is bonded, typically by lamination, to the inner face of the first cover sheet so as to be visible therethrough.

An off-center line of tearing weakness is then provided at the first cover sheet to permit the first sheet to be opened to expose inner folds of the leaflet member.

In another embodiment, a multi-layered label comprises first and second cover sheets which may typically be opaque, being sealed together at opposed ends. A multi-layer, folded-strip leaflet member is positioned between the first and second cover sheets. An end layer of the folded leaflet member strip is bonded to an inner face of the first cover sheet. An ultimate end portion of the end layer of the folded leaflet is positioned adjacent one of the opposed ends of the label, and is reverse-folded to extend toward the center of the label to define a tab member.

The first cover sheet and the bonded portion of the end layer of the folded leaflet define lines of tearing weakness which are in registry with each other so that both the first cover sheet and end layer may be simultaneously torn open by tearing the lines of weakness. The lines of weakness are located adjacent the tab member, and a slot is defined in the first cover sheet, which is positioned and proportioned to receive the tab member subsequent to opening of the label by rupturing of the lines of tearing weakness.

Thus, the label may be opened, and the folded-strip leaflet member unfolded to read the contents, for example handling instructions for a drug or a chemical. Following this, the folded-strip leaflet member may be refolded, and the tab placed through the slot in the first cover sheet so that the label is folded up again.

Typically, in many of the labels of this invention, the outermost printing of the label presented to the viewer prior to opening is duplicated on the innermost layer, for example, the inner surface of the second cover sheet, or the last layer of the leaflet if the leaflet is bonded to the second cover sheet. This permits the most essential portions of the label to remain permanently on the container even if someone tears away the leaflet.

The above-described multi-layered label embodiment may also carry an adhesive layer on its outer face and a removable backing as previously described.

As a third specific embodiment in accordance with this invention, a multi-layered label may once again define first and second cover sheets sealed together at opposed ends, and a multi-layer folded leaflet member positioned between the first and second cover sheets. At least one layer of the leaflet member is bonded to an inner face of the cover sheet, a portion of the last layer of the leaflet member adjacent the second cover sheet being folded over adjacent one opposed end of the label to form a tab portion extending toward the center of the label.

A slot is then defined in the first cover sheet which is positioned and proportioned to receive the tab portion so that the label may be reclosed after opening in the manner described above. A line of tearing weakness as before is defined in the first cover sheet adjacent one opposed end to which the tab portion is adjacent. Accordingly, breaking of the line of tearing weakness permits the first cover sheet to be opened to expose the multi-layer, folded leaflet member. The tab member may then be used to reclose the label.

The leaflet member of this particular embodiment may define a plurality of pages secured together at one end only in book form. Alternatively, the leaflet may comprise a folded strip if desired.

In this third embodiment an adhesive layer may be carried on the outer face of the second cover sheet, along with a removable backing as described above.

DESCRIPTION OF THE DRAWINGS

In the drawings,

FIG. 1 is a perspective view of a label of this invention attached on a container.

FIG. 2 is a perspective view similar to FIG. 1 showing the label in an open, unfolded form.

FIG. 3 is an exploded perspective view of a label of this invention prior to assembly.

FIG. 4 is a longitudinal sectional view taken along line 4—4 of FIG. 3.

FIG. 9 is a perspective view of a third embodiment of the label of this invention.

FIG. 10 is a perspective view of the label of FIG. 9, with portions broken away showing the label in its open configuration.

FIG. 11 is a perspective view showing the label of FIG. 10 after it has been reclosed once again using the tab.

FIG. 12 is a sectional view taken along line 12—12 of FIG. 9 but in exploded form.

FIG. 13 is a fragmentary perspective view similiar to FIG. 10 but showing a different embodiment.

DESCRIPTION OF SPECIFIC EMBODIMENTS

Figure 5:
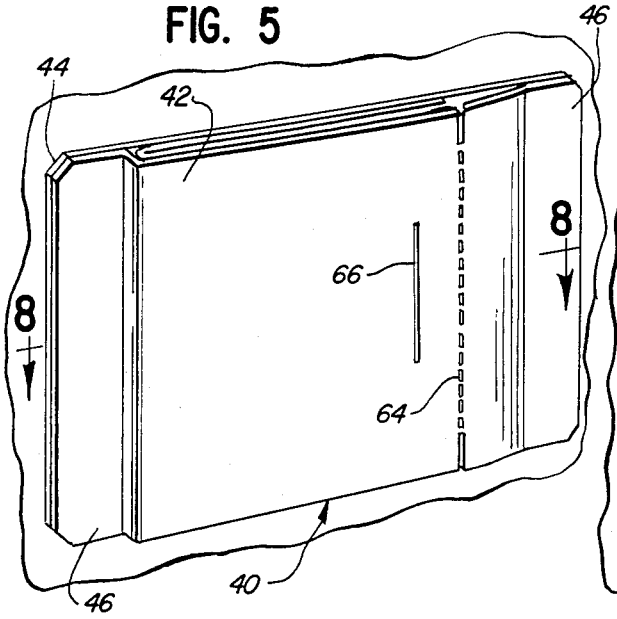
FIG. 5 is a perspective view of a second embodiment of the label of this invention.

Referring to FIGS. 1 through 4, label 10 is shown stuck to a container 12. As particularly shown in FIG. 3, label 10 defines first cover sheet 14 and second cover sheet 16 which in this particular embodiment is coated on its outer face with contact adhesive 18 and has a removable backing sheet 20 protecting such contact adhesive. For application on container 12 the backing sheet 20 has been removed.

First sheet 14 also contains on its inner face a layer of contact adhesive 22 to which a layer 24 of folded leaflet member 26 is adhered. It can be seen that leaflet member 26 is made of a strip of paper folded into a series of layers or panels. While first cover sheet 14 adheres to leaflet 26 in its central portions, its two end portions 30, 32 adhere to second cover sheet 16 at the two end areas to seal label 10 together.

First cover sheet 14 carries a line of tearing weakness 28 which may be a series of perforations. Also, both cover sheets 14, 16 may be transparent, so that the printing on the outer face of layer 24 of label 26 may be visible through cover sheet 14 to the reader.

When it is desired to gain access to the label to unfold and read it, one tears line of weakness 28 to open it. Central portion 32 of first sheet 14 can then swing open about line 34 which may, if desired, be creased to form a hinge or may just naturally be an area of folding as the center section is opened. As shown in FIG. 2, leaflet 26, which is in folded strip form, may be unfolded as shown in the phantom lines for study of the information thereon. Typically, the central portion of second cover sheet 16 will also contain information corresponding to the information on the outer face of layer 24 of the leaflet member. First cover sheet 24 may also be torn away on line 34 for removal, if desired, with line 34 being perforated.

Accordingly a multi-layered label is provided which may be easily opened for reading extensive information contained therein.

The labels of this invention may be automatically assembled, with their various parts being cut from roll stock and appropriately processed by folding, gluing and perforating machinery.

Turning now to FIGS. 5 through 8, a second embodiment of this invention is disclosed. Label 40 defines first and second cover sheets 42, 44 which are sealed together at their respective ends 46. As shown in the exploded view of FIG. 8, both layers 42 and 44 are coated with contact adhesive 50, with removable backing 48 covering and protecting the contact adhesive layer on second sheet 44 until it is desired to stick the label to a container or the like.

Figure 6:
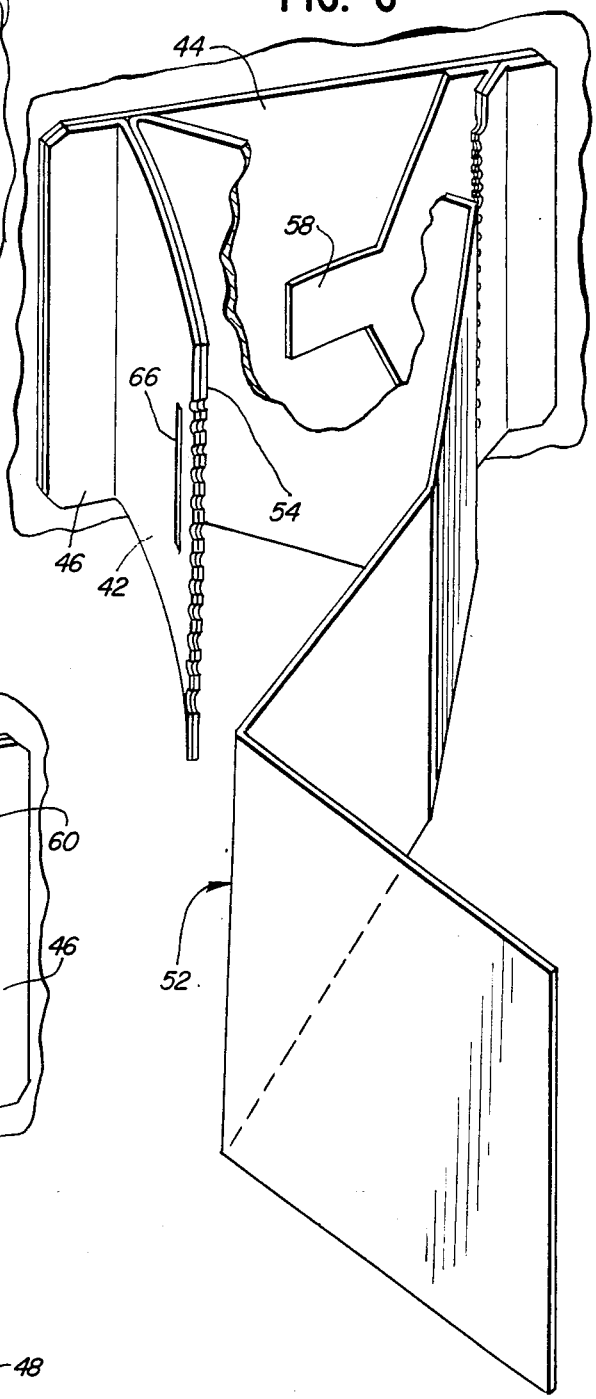
FIG. 6 is a perspective view, with a portion broken away, of the label of FIG. 5 after opening.
Figure 7:
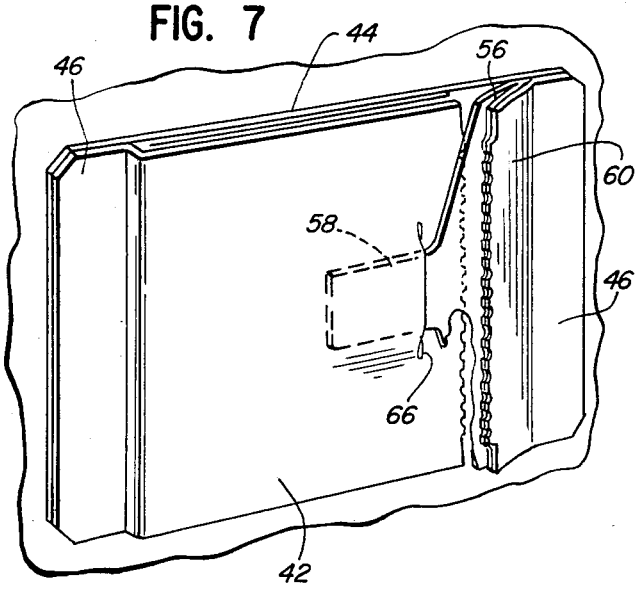
FIG. 7 is a perspective view of the label of FIG. 6 after it has been reclosed once again using the tab.
Figure 8:
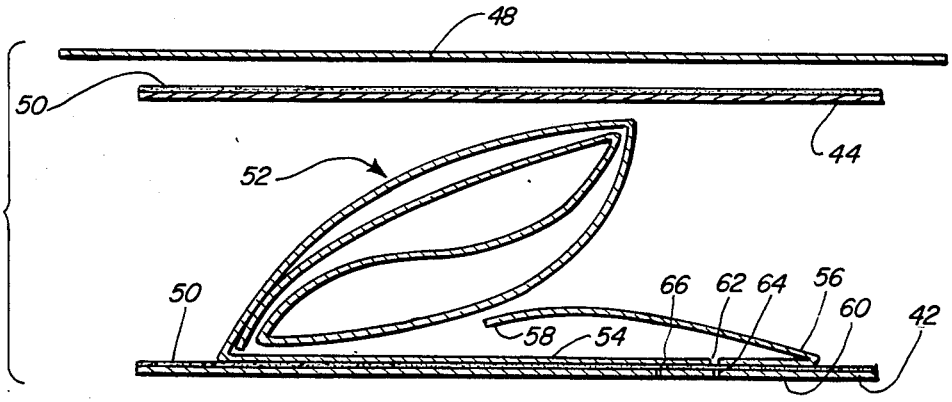
FIG. 8 is a sectional view taken along line 8—8 of FIG. 5 but in exploded form.

Between the two cover sheets 42, 44 is a folded label 52, the folded layers of which are best seen in FIGS. 6 and 8. An end layer 54 of folded leaflet strip 52 is bonded to the inner face of first cover sheet 42 by means of its layer 50 of contact adhesive.

An ultimate end portion 56 of layer 54 adjacent one of the opposed ends of label 40 defines a tab member 58. Ultimate end portion 56 is, in turn, sealed to end portion 60 of first cover sheet 42.

First cover sheet 42 and end layer 54 of leaflet member 52 together define lines of tearing weakness 62, 64 which are in registry with each other so that both first cover sheet 42 and end layer 54 may be simultaneously torn open by tearing the lines of weakness 62, 64. Slot 66 is defined in first cover sheet 42 which, as shown, is positioned and proportioned to receive tab member 58 after opening of the label by rupturing lines of weakness 62, 64.

FIG. 6 shows the label in its open configuration where leaflet 52 can be studied. Thereafter, the system is reclosed in the manner of FIG. 7, with tab 58 passing through slot 66, after leaflet 52 has been refolded and placed between the two cover sheets 42, 44.

FIGS. 9 through 12 illustrate a third embodiment of the invention of this application. Label 70 carries first and second cover sheets 72, 74 in a manner similar to the previous embodiments.

However, in this instance, the leaflet member is a booklet 76 of several folded sheets held together by a staple 78 in the conventional manner of assembling a booklet. The first sheet 80 of booklet 76 adheres to first cover sheet 72 by its layer of contact adhesive as in previous embodiments. If desired, last sheet 82 of booklet 76 may adhere to second cover sheet 74, or it may be unattached. Specifically, last sheet 82 may fit between part of end seal 83 of first and second cover sheets 72, 74 for retention. An ultimate end portion 84 of last sheet 82 of booklet 76 defines a tab member 86. A line of tearing weakness 88, typically perforations, is defined in first cover sheet 72. First cover sheet 72 and sheet 80 also define a slot 90 positioned and proportioned to receive tab portion 86.

Accordingly, label 70 may be applied to a surface 92 by means of contact adhesive 94 on second cover sheet 74 by removing protective layer 96 and applying the label. When it is desired to open label 70, one ruptures line of tearing weakness 88 to cause the label to open as is shown in FIG. 10. Leaflet 76 is in booklet form so it does not unfold, but the reader can page through the various pages 100 for the information contained therein.

When it is desired to refold the booklet, tab 86 is brought forward of the remainder of the booklet and inserted into slot 90 of cover 72 for reclosing of the label.

FIG. 13 shows a modified version of a label which otherwise is similar to the design of FIGS. 9–12. Tab 86 is eliminated and in its place ultimate end portion 84*a*, retained by seal line 83*a*, carries gummed adhesive line 102 to stick to the first cover sheet when resealing of the label is desired.

Accordingly, the labels of this invention provide improved characteristics. They can be recloseable so that after study of the contents, the label can be closed up again so that it will not be damaged or torn off during storage or moving of the container or other object to which it is affixed.

Also, the design of the label is particularly susceptible to automated manufacture, resulting in great improvements in economy and manufacturing volume.

The above has been offered for illustrative purposes only, and is not intended to limit the scope of the invention of this application, which is as defined in the claims below.

That which is claimed is:

1. In a multi-layered label which may be torn open to expose an interior leaflet, the improvement comprising, in combination:

first outer and second inner cover sheets with an adhesive layer on at least one side thereof, and peripherally sealed together, and a separate multi-layer leaflet member positioned between said first and second cover sheets, at least one layer of said leaflet member being adhered to an internal face of one of said first and second sheets, and a line of tearing weakness in said first cover sheet to permit opening thereof for access to said leaflet member.

2. The label of claim 1 in which said first cover sheet is made of transparent material, whereby printing on the leaflet member is visible therethrough.

3. The label of claim 1 in which said leaflet member comprises a strip folded into a plurality of layers.

4. The label of claim 1 in which an end of one layer of said leaflet member defines a tab member positioned by folding between said first and second cover sheets and adhering to said second cover sheet, said first cover sheet defining a slot positioned and proportioned to receive said tab for reclosing of the label after opening thereof.

5. The label of claim 1 in which said second cover sheet carries an adhesive layer on its outer face, and a removable backing covering said adhesive layer.

6. In a multi-layered label which may be torn open to expose an interior leaflet, the improvement comprising, in combination:

first outer and second inner cover sheets with an adhesive layer on at least one side thereof, and sealed together at opposed ends, and a multi-layer folded leaflet member positioned between said first and second cover sheets, at least the first cover sheet being transparent, one layer of said leaflet member defining a printed outer face which is bonded to an inner face of the first cover sheet so as to be visible therethrough, and an off-center line of tearing weakness in said first cover sheet to permit said first sheet to be opened to expose inner folds of said leaflet member.

7. The label of claim 6 in which said second cover sheet is transparent.

8. The label of claim 6 in which said second cover sheet carries an adhesive layer on its outer face, and a removable backing covering said adhesive layer.

9. In a multi-layered label which may be torn open to expose an interior leaflet, the improvement comprising, in combination:

first and second cover sheets sealed together at opposed ends, and a multi-layer, folded-strip leaflet member positioned between said first and second cover sheets, an end layer of said folded leaflet member strip being bonded to an inner face of the first cover sheet, an ultimate end portion of said end layer adjacent one of the opposed ends of said label being reverse folded to extend toward the center of said label and defining a tab member, said first cover sheet and end layer of the folded leaflet defining lines of tearing weakness in registry with each other so that both said first cover sheet and end layer may be simultaneously torn open by said lines of weakness, said lines of weakness being located adjacent said tab member, and a slot defined in said first cover sheet positioned and proportioned to receive said tab member subsequent to opening of said label by rupturing said lines of tearing weakness.

10. This label of claim 9 in which said first cover sheet is opaque.

11. The label of claim 9 in which said second cover sheet carries an adhesive layer on its outer face, and a removable backing covering said adhesive layer.

12. In a multi-layered label which may be torn open to expose an interior leaflet, the improvement comprising, in combination:

first and second cover sheets sealed together at opposed ends, and a multi-layer, folded leaflet member positioned between said first and second cover sheets, at least one layer of said leaflet member being bonded to an inner face of said first cover sheet, a portion of said last layer of the leaflet member adjacent the second cover sheet being folded over said one layer adjacent one opposed end to form a tab portion extending toward the center of said label, a slot defined in the first cover sheet and cover of leaflet member in registry, positioned and proportioned to receive said tab portion, and a line of tearing weakness defined in said first cover sheet adjacent said one opposed end, whereby breaking of said line of tearing weakness permits said first cover sheet to be opened to expose said milti-layer, folded leaflet member, and said tab member may then be used to fit in said slot to reclose the label.

13. The multi-layered label of claim 12 in which said folded leaflet member defines a plurality of pages secured together at one end only in book form.

14. The label of claim 12 in which said second cover sheet carries an adhesive layer on its outer face, and a removable backing covering said adhesive layer.

* * * * *